US007127785B2

(12) United States Patent
Sear

(10) Patent No.: US 7,127,785 B2
(45) Date of Patent: Oct. 31, 2006

(54) INTERLACING TEXTILE SLIDE JET

(75) Inventor: Nicolas C. Sear, Winston-Salem, NC (US)

(73) Assignee: International Machinery Sales, Inc, Winston-Salem, NC (US)

( * ) Notice: Subject to any disclaimer, the term of this patent is extended or adjusted under 35 U.S.C. 154(b) by 5 days.

(21) Appl. No.: 10/530,961

(22) PCT Filed: Feb. 11, 2003

(86) PCT No.: PCT/US03/04259

§ 371 (c)(1),
(2), (4) Date: Apr. 11, 2005

(87) PCT Pub. No.: WO03/069036

PCT Pub. Date: Aug. 21, 2003

(65) Prior Publication Data

US 2006/0185137 A1 Aug. 24, 2006

(51) Int. Cl.
*D02G 1/16* (2006.01)
*D02J 1/08* (2006.01)

(52) U.S. Cl. ..... 28/271; 28/272

(58) Field of Classification Search ..... 28/271, 28/272, 274, 273, 275, 276, 258, 220, 283; 57/289, 350, 333, 908
See application file for complete search history.

(56) References Cited

U.S. PATENT DOCUMENTS 4,936,000 A * 6/1990 Nabulon et al. ..... 28/272
5,964,015 A * 10/1999 Sear ..... 28/274
6,148,490 A * 11/2000 Bertsch ..... 28/272
6,163,944 A * 12/2000 Lin ..... 28/274
6,308,537 B1 * 10/2001 Lin ..... 66/125 A
6,311,376 B1 * 11/2001 Hinchliffe et al. ..... 28/272
6,438,812 B1 * 8/2002 Jansen ..... 28/274
6,834,418 B1 * 12/2004 Chiang ..... 28/274

* cited by examiner

*Primary Examiner*—Amy B. Vanatta
(74) *Attorney, Agent, or Firm*—Robert W. Pitts

(57) ABSTRACT

A textile interlacing slide jet (2), (102) includes a jet body (10), a jet carriage (40, 140) on which a ceramic jet nozzle insert (30, 130) is mounted, and a spring housing (52) that includes a stack of compression spring washers (70,170), such as Belleville washers. The spring housing (52) is rotatable, relative to an upper arm (20) of the jet body (10), to a tilted position to permit insertion and removal of the jet carriage (40, 140) and the jet nozzle insert (30, 130) without the use of special tools. The compression spring washers (70, 170) are located in the spring housing (52) directly above a ceramic plate (66, 166) located on the bottom of the spring housing. These springs (70, 170) urge the ceramic plate or bottom layer into engagement of the top surface of the jet nozzle insert (30, 130) so that the ceramic plate (66, 166) can close a yarn channel when the jet carriage (40, 140) and the jet nozzle insert (30, 130) have been moved to a closed position by rotation of an actuating lever (80, 180).

30 Claims, 7 Drawing Sheets

FIG 16
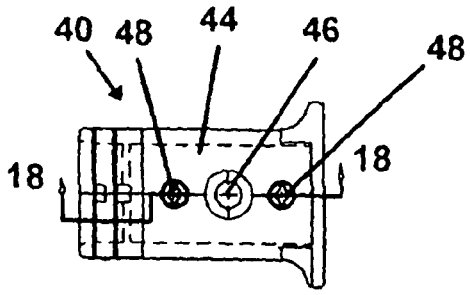
FIG 17
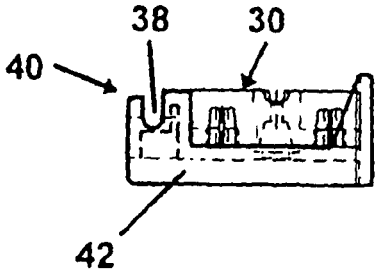
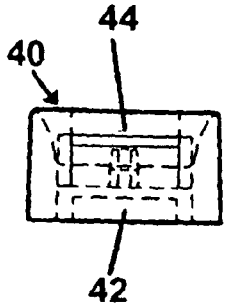
FIG 19
FIG 18
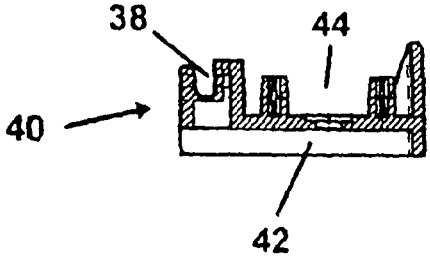

INTERLACING TEXTILE SLIDE JET

BACKGROUND OF THE INVENTION

1. Field of the Invention

This invention is related to textile jet's in which a high pressure stream of air is directed into engagement with a yarn passing through the textile jet. More specifically, this invention is related to textile interlacing jets.

2. Description of the Prior Art

One form of conventional textile interlacing jet is the slide jet. This device employs a jet nozzle insert having a yarn channel intersected by an orifice through which a high velocity air jet is directed. Yarn strands passing through the yarn channel are interlaced or entangled.

The jet insert in a slide jet can be moved linearly between an open position in which yarn can be positioned within the exposed channel and a closed position in which the yarn is subjected to that air jet blowing into a yarn channel in which the top has been closed. Hence the name slide jet has been employed for this type interlacing jet assembly. In a conventional slide jet, movement between the open and closed positions imparted by rotation of a lever that is mounted on a jet body. The lever engages a jet carriage on which the jet nozzle insert is mounted, and as the lever is rotated the jet carriage moves or slides along a linear patent between open and closed positions.

The jet carriage and the jet nozzle insert move between the jet body base on which the jet carriage is mounted and an upper sprint, loaded arm that extends above the jet carriage and is spaced from the jet body base. A ceramic plate is mounted on the end of the spring loaded arm and this ceramic plate slides along the top of the nozzle insert, which is also a ceramic member. This ceramic plate closes the top of the yarn channel when the jet carriage and the insert have been moved to the closed position.

In the most common slide jet configuration, the jet body base includes an rear arm that extends at right angles to a lower base arm on which the jet carriage reciprocates. The rear arm includes a spring cavity in which a spring in mounted. This spring engages a rear end of the spring loaded arm that extends along the top of the jet carriage. This spring arm is pivoted, and the spring urges the ceramic plate, located at the opposite end of the spring loaded arm, downward against the top of the ceramic insert.

When it becomes necessary to remove the jet nozzle insert, a special tool in the form of a key having offset cylindrical sections is inserted into an opening extending through both the upright portion of the jet body base and the spring loaded arm. These aligned openings are located between the pivot point of the spring loaded arm and the ceramic plate. Rotation of the key forces the spring loaded arm upward to relieve the force exerted by the ceramic plate on the jet nozzle insert. The jet carriage and the jet nozzle insert can then be removed from the end of the jet body base. The jet nozzle can be replaced by inserting the jet carriage back on the base while the spring loaded arm is cammed to its release position by the special key or tool.

The instant invention represents an improvement over this conventional slide jet configuration in at least two respects. First the instant invention permits removal of the jet nozzle insert, and the jet carriage on which it is mounted, without the need for special tools. Indeed in the preferred embodiment of this invention, no tool is need to remove or insert the jet carriage and insert. The instant invention also comprises a simpler and less expensive structure than the conventional slide jet configuration described above. The jet body can be formed from an extruded blank that can be cut into segments. Relatively simple secondary machining operations can then be use to fabricate a one-piece jet body.

SUMMARY OF THE INVENTION

According to this invention, a textile interlacing jet includes a body, and interlacing jet insert and a spring housing. The body includes a compressed air inlet. The interlacing jet insert is mounted on a jet carriage. The jet carriage is mounted to slide on the body so that the jet carriage can be shifted between an open position and a closed position in which the inter lacing jet insert is aligned with the compressed air inlet. The spring housing assembly is mounted on the body above the compressed air inlet, and includes at least one compression spring washer. This compression spring washer is positioned to exert a force against the interlacing jet to retain the jet carriage on the body as the jet carriage slides between the open and closed positions.

Stated differently, the interlacing jet insert on the textile interlacing jet is mounted on a jet carriage, which is slidably mounted on a body. The body includes a base with a compressed air inlet extending through the base. An upper arm is spaced from the base and extends over the base and over the compressed air inlet. A compression spring is attached to the upper arm above the compressed air inlet. The compression spring presses a slide layer into engagement with a top surface of the interlacing jet insert to retain the interlacing jet insert and the jet carriage as the jet carriage is moved linearly relative to the body.

This textile interlacing jet includes a spring housing assembly, with a spring housing having a bottom layer and a spring positioned above the bottom layer. The spring housing assembly extends between an upper section or arm and the lower section or arm of the body. The spring housing is attached to the upper section of the body by a pin so that the spring housing can rotate or tilt relative to the body. The spring is positioned to press the spring housing bottom layer against a top surface of the interlacing jet insert to retain the jet carriage on the body while permitting the interlacing jet and jet carriage to slide relative to the body and to the spring housing assembly. The jet carriage, with the jet insert mounted thereof, can also be removed from beneath the tilting spring housing assembly by the application of a linear force without the need for special tools. The jet carriage and the jet insert can also be inserted on the jet body in a similar fashion.

BRIEF DESCRIPTION OF THE DRAWINGS

FIG. 16 is a top view of the jet carriage on which the jet insert is mounted in the textile interlacing jet assembly according to this invention.

FIG. 17 is a side view of the jet carriage of FIG. 16.

FIG. 18 is a section view taken along section lines 18—18 shown in FIG. 16.

FIG. 19 is an end view of the jet carriage of FIG. 16.

DETAILED DESCRIPTION OF THE PREFERRED EMBODIMENT

FIGS. 1–4 show a textile jet interlacing assembly 2, which comprises the preferred embodiment of this invention. Component parts of this textile jet interlacing assembly 2 are shown in FIGS. 6–19. Although the representative embodiment of this invention is in the form of an interlacing jet or interlacing jet nozzle, it will be apparent to one of ordinary skill in the art that the essential elements of this jet assembly can also be employed in other types of textile jets that use a jet of air or other gas to treat a textile fiber or yarn. For example, this invention could also be adapted to a texturing device.

Figure 1:
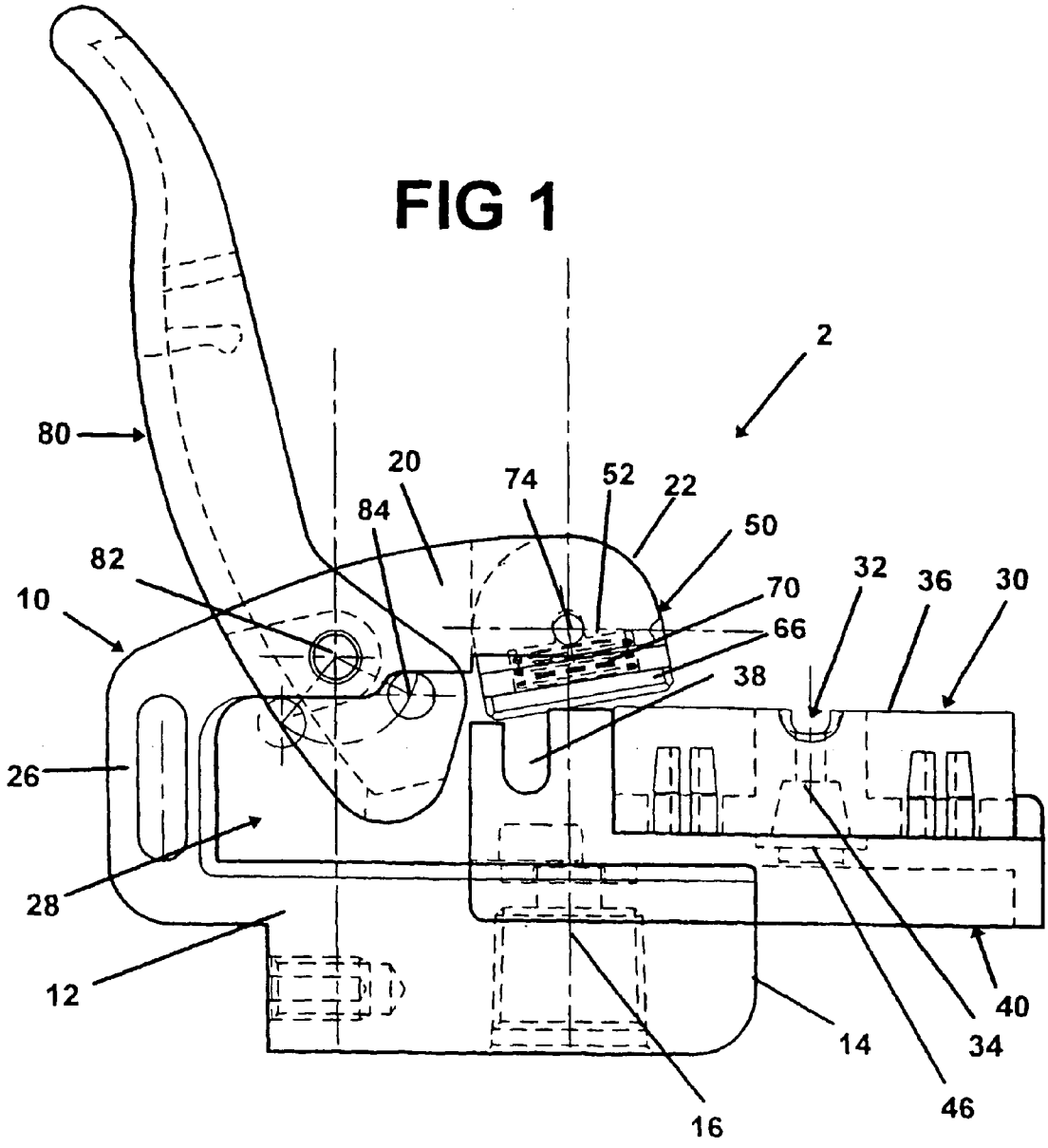
FIG. 1 is a side view of a textile interlacing jet assembly, according to this invention, showing the jet assembly in a position in which a jet or nozzle insert is either being removed from or inserted into an operative position.
Figure 2:
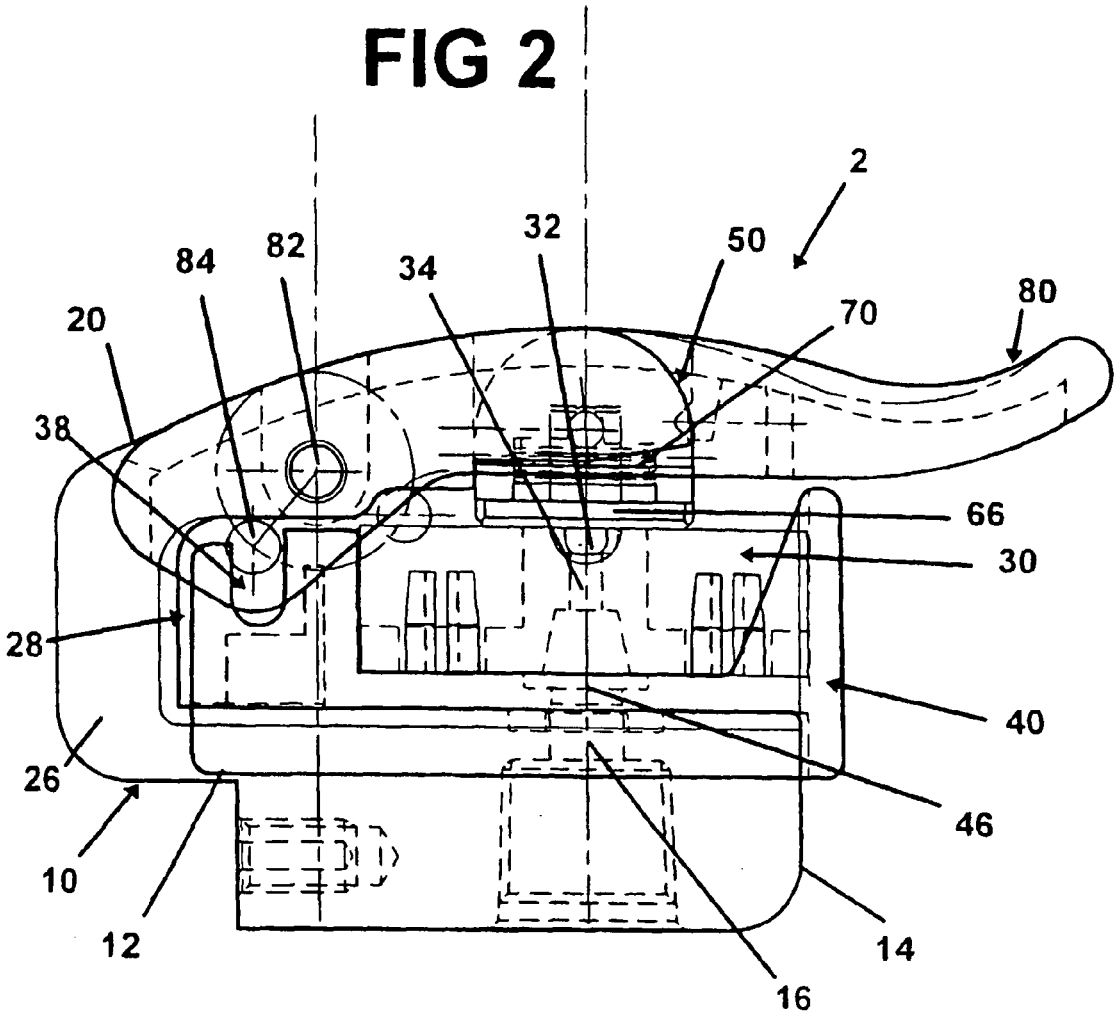
FIG. 2 is a side view of the jet of FIG. 1 showing the jet in the closed position, in which a yarn that is passing through the jet assembly is treated.
Figure 3:
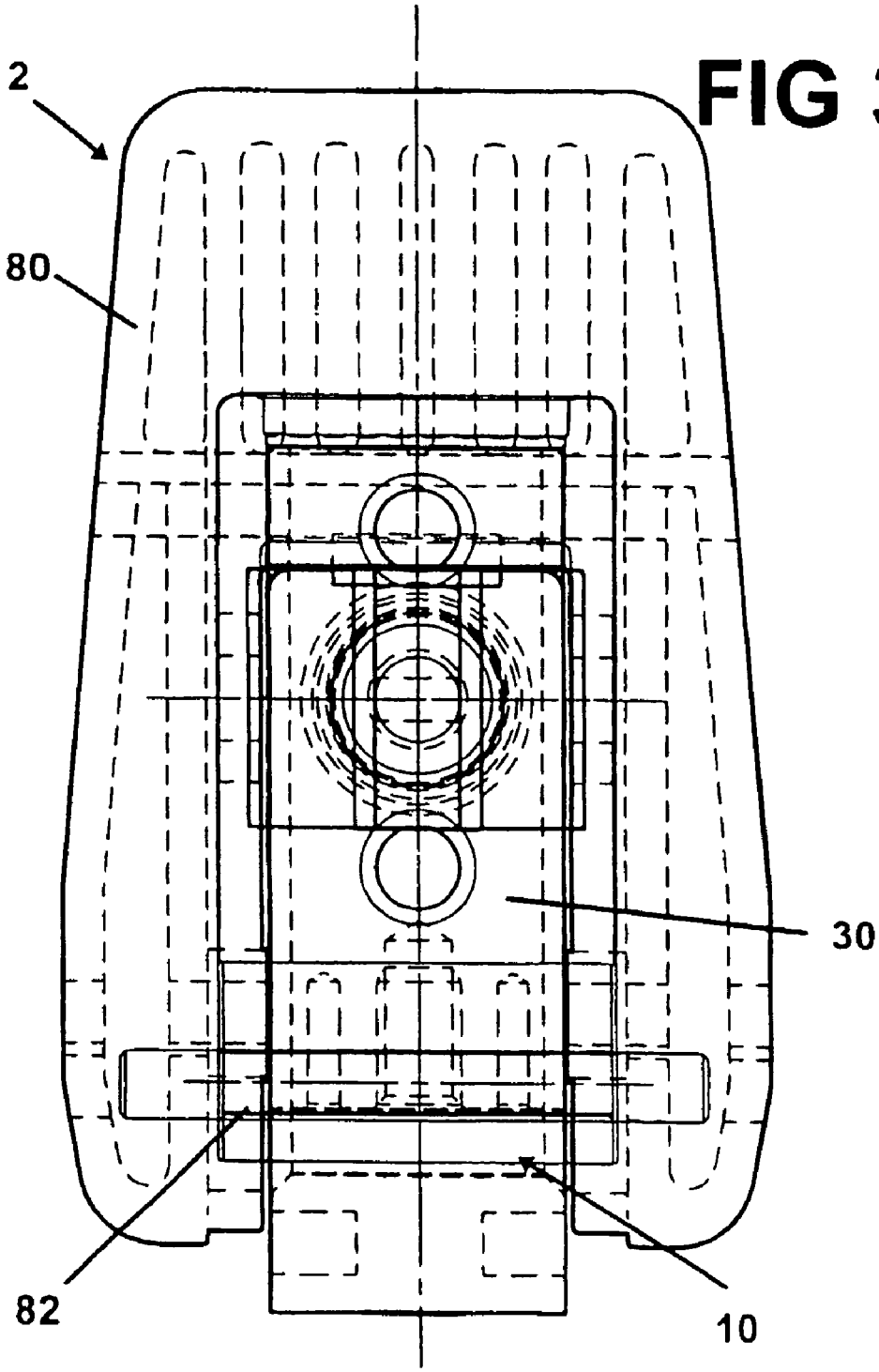
FIG. 3 is a top plan view of the jet of FIGS. 1 and 2 in the closed position.
Figure 4:
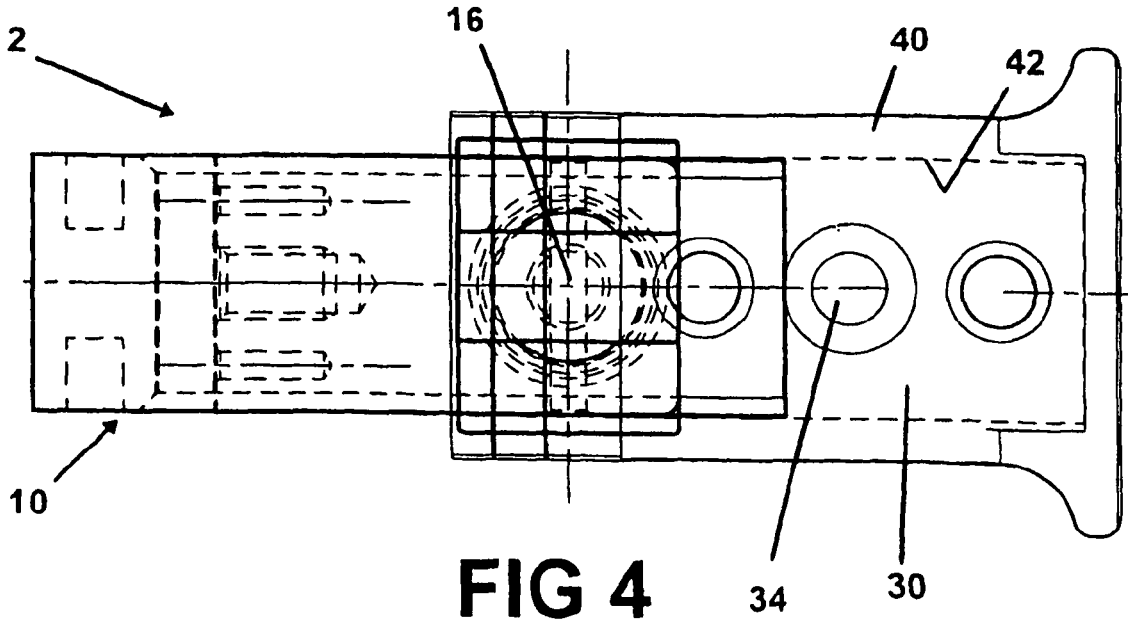
FIG. 4 is a bottom view of the jet of FIGS. 1–3, showing the jet in the open position, also shown in FIG. 1.

FIG. 1 shows the interlacing jet assembly 2 in a position in which the jet 2 is being assembled or dissembled, while FIG. 2 shows the same interlacing jet assembly 2 in a closed or operative position. In an open position, intermediate to those shown in FIGS. 1 and 2, a yarn (not shown) can be laced into the exposed yarn channel 32 of a sliding jet insert 30. In the open position the yarn channel 32 will be exposed from above in substantially the same manner as shown in FIG. 1. When the jet insert 30 and the jet carriage 40, on which it is mounted, are moved to the closed position of FIG. 2, an inlet 16 on the jet body 10 will be in alignment with all orifice 34 on the jet insert 30 and an orifice 46 on the jet carriage 40. Since the air inlet 34 on the jet body 10 is in communication with a conventional source of high pressure gas or air (not shown), the yarn in the yarn channel 32 will be exposed to a high speed, high pressure jet of gas or air, which will interlace yarn filaments as they pass through the yarn channel at a relatively high velocity.

In addition to the body 10, the interlacing jet insert 30 and the jet carriage 40, the interlacing jet assembly 2 also includes a spring housing 50 that is mounted on the jet body 10 so that a bottom layer 66 will engage the top surface 36 of the jet or nozzle insert 30. A lever 80, rotatable relative to the jet body 10, will move the jet carriage 40, and the jet nozzle insert 30 mounted thereon, between an open and a closed position. However, when the lever 80 is in the position shown in FIG. 1, the jet carriage 40 and the insert 30 can be removed from the jet assembly 2 by pulling the carriage 40 to the right as shown in FIG. 1. When this subassembly is removed from the jet assembly 2, the insert can be replaced, repaired or cleaned. Then the jet carriage 40 and the insert 30 can be inserted into position by application of a force acting to the left, as seen in FIG. 1, on the jet carriage 40 to cause this subassembly to move in a linear fashion along the jet body 10 into the open position in which the yarn channel 32 is exposed. In that position the lever 80 is in engagement with the jet carriage 40 so that rotation of the lever 80 will move the carriage 40 and the jet nozzle insert 30 back and forth between the open and the closed position as shown in FIG. 2.

The lever 80 is pivoted about a fulcrum pin 82 mounted on the jet body 10. The jet carriage 40 includes a slot 38, that will receive an actuating pin 84 that is offset from the fulcrum pin 82 and is mounted on the lever 80. When the lever 82 is rotated while the pin 84 is seated in the slot 38, rotation of the lever 82 will cause the jet carriage 40, and jet insert 30, to slide back and forth between an open and a closed position. However, the lever 80 can be rotated to the position shown in FIG. 1 in which the pin 84 is clear of the slot 38. In this position, the jet carriage 40 can be extracted from the assembly or inserted on the assembly by the application of a sufficient lateral force. It is not necessary to disengage any of the other components of the assembly to remove the jet carriage 40 and the insert 30. Thus no keys or other tools are needed to release the jet carriage 40 from the jet assembly 2.

The jet assembly 2 also includes a series of compression springs or spring washers 70 mounted in a spring housing 50 that is pinned to the jet body 10 so that the spring housing 50, and the spring 70 can rotate or tilt relative to the jet body 10 as the jet carriage is inserted or extracted. These compression springs 70 act to force a bottom layer 66 of the spring housing 50 into sliding engagement with the top surface 36 of the jet insert 30. These springs 70 serve to hold the jet carriage 40 in engagement with the body 10, but the jet carriage 40 and the nozzle insert 30 can still slide between the open and closed operative positions in response to rotation of the lever 80. The compression springs 70 also hold the bottom layer 66 against the insert 30 so that the spring housing bottom layer 66 serves as a top plate closing the top of the yarn channel 32 when the assembly is in the closed position shown in FIG. 2. Thus the layer 66 serves to seal the yarn channel in the closed position. The bottom layer 66 is formed from the same ceramic material that is used to fabricate the jet insert 30 so that the layer 66 can serve as an impingement surface for high pressure air, or some other high pressure gas entering the yarn channel 32 through aligned orifices 16, 46 and 34. This ceramic material also has a smooth exterior surface so that the coefficient of friction between these two maintaining ceramic surfaces is low enough to permit the insert 30 to slide past the bottom layer 66 as the jet carriage 40 and insert 30 move between the open and closed positions or as the insert 30 is extracted or inserted into the remainder of the assembly.

Figure 5:
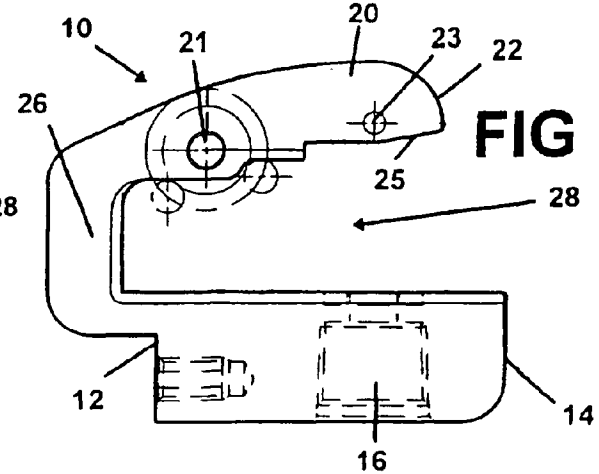
FIG. 5 is a side view of the jet body employed in the textile interlacing jet assembly of FIGS. 1–4.
Figure 9:
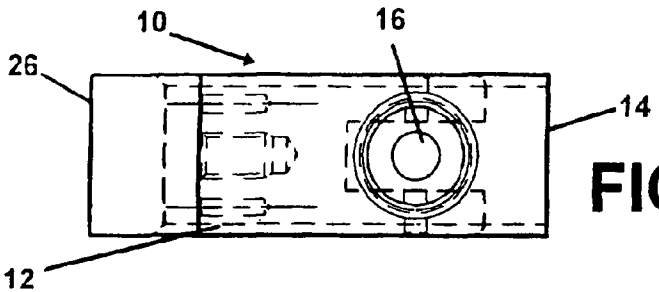
FIG. 9 is a bottom view of the jet body of FIG. 5, showing the compressed air inlet on the jet body.

The other components of the interlacing jet assembly 2 are mounted on a body 10 that comprises a one-piece structural member fabricated from a metal. The jet body includes a base or lower body section 12 that has the configuration of a lower arm. An upper body section or upper arm 20 projects over the top surface of the base arm 12. The upper arm 20 is joined to an intermediate upright arm 26 that in turn extends upward from the base arm 12. These three arms 12, 20, 26 form a generally U or C-shaped configuration when viewed from the side as seen in FIG. 5. The upper arm 20 forms a cantilever beam with its supported end being its juncture with the upright or rear member 26. Since the three arms 12, 20, and 26 are part of the same, relatively rigid, metal member, the upper arm will not substantially deflect, relative to the base arm 12, either when the jet assembly is in the open an closed positions, and when the jet carriage 40 and jet insert 30 are assembled to or removed from the jet body 10. Upper arm 20 extends generally parallel relative to the base arm 12, although there are several offset sections formed on the lower surface of upper arm 20. A gap 28 is formed between the upper arm 20 and the base arm 12, and this gap provides space for the jet carriage 40 with the nozzle insert 30 mounted thereon. Gap 28 is open on the end of the body 10 opposite from the upright arm 26 to provide sufficient clearance for the jet carriage 40 and the nozzle insert 30.

Figure 6:
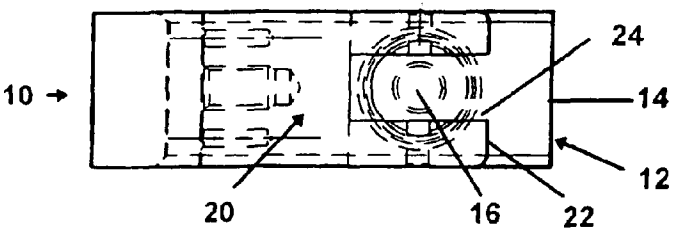
FIG. 6 is a top view of the jet body of FIG. 5.
Figure 7:
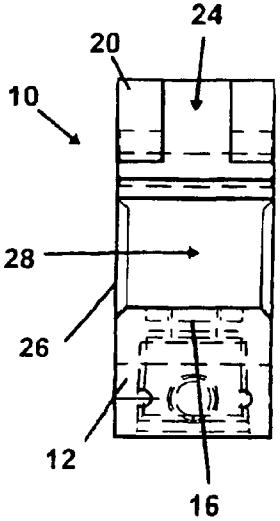
FIG. 7 is an end view of the jet body of FIG. 5, showing the open end of the jet body.
Figure 10:
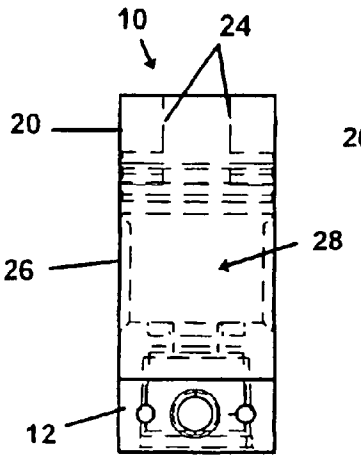
FIG. 10 is a another end view of the jet body of FIG. 5, showing, the upright member extending between the base and the cantilever top arm of the jet body.
Figure 12:
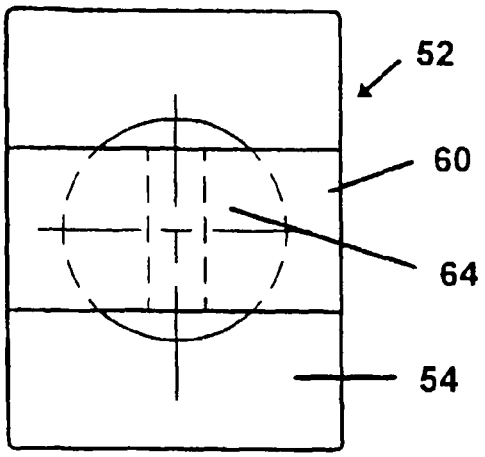
FIG. 12 is a top view of the spring housing that is mounted on the jet body of FIG. 5 in the assembled textile interlacing jet.
Figure 13:
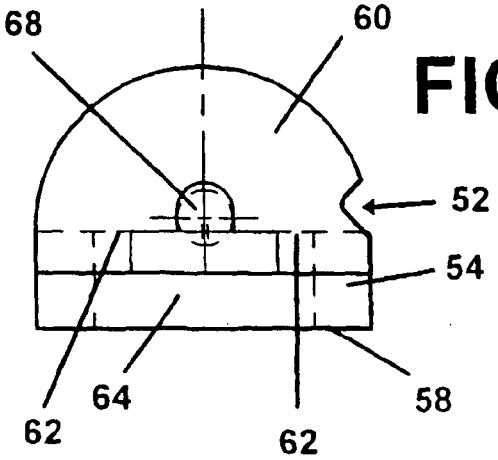
FIG. 13 is a side view of the spring housing of FIG. 12.

The upper arm 20 also includes two cylindrical openings 21 and 23, each of which extends to opposite sides of the jet body 10. Cylindrical opening 21 is located adjacent to the base of the upper arm 20 and provides space for receipt of a pin 82 which will serve as a fulcrum for the lever 80 when it is mounted for rotation on the jet body 10. Cylindrical opening 23 is located more closely adjacent to the distal end 22 of the upper arm 20. Opening 23 will receive a pin 74 on which the spring housing 50 will be rotatably mounted. As can be seen in FIGS. 6, 7 and 10 a recess 24 extends into the distal end 22 with two sections adjacent the distal end 22 of the upper arm 20 extending on opposite sides of the recess 24. Thus cylindrical opening 23 actually comprises two aligned holes extending through the sections on opposite sides of recess 24. An upwardly inclined surface 25 is also formed at the upper arm distal end 22. This inclined surface 25 will permit the spring housing 50 to rotate or tilt as the jet carriage 40 and jet insert 30 are removed from or inserted onto the jet body 10.

The jet body 10 also includes a compressed air inlet 16 machined into the lower base arm 12. This inlet is threaded so that a conventional supply line can be attached. The inlet 16 also extends completely through the base arm. Air inlet 16 is located between the base arm distal end 14 and the juncture between the base arm 12 and the upright member 26.

Figure 11:
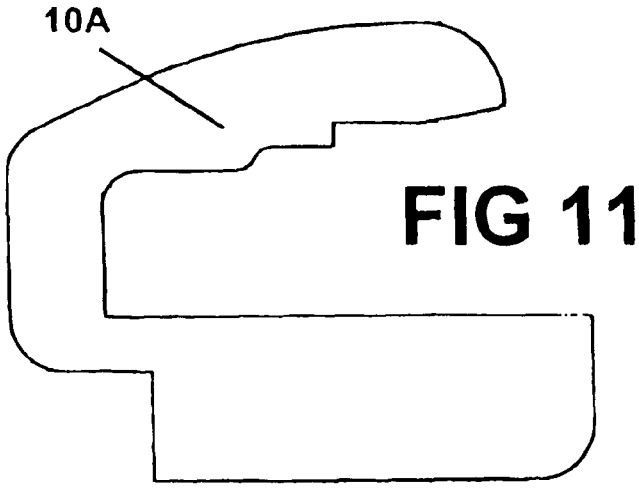
FIG. 11 is a view of the extruded blank from which the jet body of FIG. 5 is machined.

Since the jet body 10 comprises a one-piece member is can be fabricated from an extrusion 10A having the shape shown in FIG. 11. Extrusion 10A can then be cut into sections have the appropriate width for the jet body 10. In the preferred embodiment, this extrusion can be formed of aluminum. Recess 24 can be formed by milling or some other conventional metal fabrication operation. Secondary machining operations, such as drilling and tapping, can then be used to form the holes 21, 23, 23 and the air inlet 16, as well as other features for mounting and other purposes. Edges of the jet body 10 can be beveled where appropriate. Material call also be removed from the sides of the jet body 10 to insure that the finished structure has the proper physical characteristics. Fabrication of the jet body 10 by extrusion followed be secondary machining operations results in a relatively low cost for the jet body 10, and reduces the number of components that are necessary for this jet assembly 2.

Figure 15:
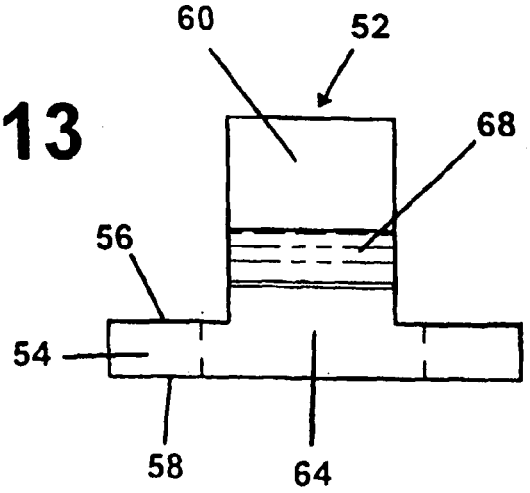
FIG. 15 is an end view of the spring housing of FIG. 12.
Figure 14:
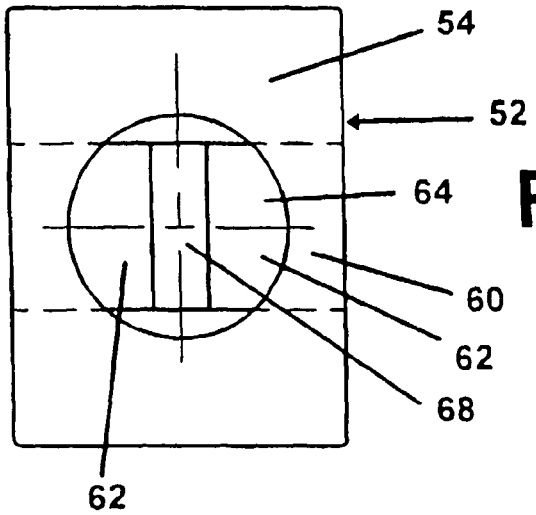
FIG. 14 is a bottom view of the spring housing of FIG. 12.

FIGS. 12–15 show a spring housing 52 that forms a part of the spring assembly 50 that is mounted adjacent the distal end of the upper cantilever arm 20. This spring housing 52 is mounted on the arm 20 by a pin 74 extending through the aligned openings 23 on opposite sides of the recess 24. The spring housing 52 comprises a one-piece metal member having a yoke 60 extending upwardly from the middle of a plate 54 of generally rectangular configuration. The thickness of the yoke 60 is approximately equal to the width of the recess 24 in the upright arm 20 so that the yoke can be inserted into this recess 24 on the upper arm distal end 22. The yoke 60 also includes a semi-elliptical hole 68 extending between opposite sides of the yoke. This hole 68 is not round. Instead it is slightly elongated and it is open on the lower portion of the yoke 60 where it communicates with a cylindrical cavity 64 that extends upwardly from the bottom surface 58 of the plate 54. As can be seen in FIGS. 14 and 15, the cylindrical cavity 64 has a diameter that is greater than the thickness of the yoke 60. However, two downwardly facing surfaces 62 are formed at the top of the cavity 64 by the portions of the yoke 60 on either side of the hole 68. The diameter of the spring cavity 64 is significantly less than the length or width of the rectangular plate 54 leaving a flat lower surface 58 of the plate surrounding the cavity 64. This flat lower surface 58 will provide sufficient space for bonding a bottom ceramic layer 66 to the spring housing 52 after compression spring washers 70 are positioned within the spring cavity 64. The bottom layer 66 is bonded to the plate lower surface by an adhesive.

In the preferred embodiment a stack of compression spring washers 70 are positioned within the spring cavity 64. These compression spring washers are preferably Belleville washers, and in the preferred embodiment four spring washers are used. The spring washers 70 are loaded into the spring cavity from below, and the top washer will initially rest against the downwardly facing surfaces 65. After the stack of spring washers or Belleville washers 70 have been loaded into the cavity 64, a retaining ring, not shown, is inserted into the cavity, below the compression springs 70. This retaining ring is then deformed so that it engages the cylindrical walls of the spring cavity 64 to hold the cylindrical compression springs in place between the downwardly facing surfaces 62 and the retaining ring. Typically a brass retaining ring will be used. Deformation of the retaining ring will also preload the stack of compression spring washers. At this point the ceramic bottom layer 66 is adhesively secured to the spring housing plate 54. It should be understood that other means could be employed for retaining the compression springs in the spring cavity 64 and in certain embodiments the compression springs could even bear directly on the top surface of the ceramic bottom layer.

At this point the spring housing assembly 50, with the compression springs 70 mounted in the spring housing 52 to which the bottom layer 66 is bonded, can be assembled to the jet body 10. The yoke 60 is inserted into the recess 24 at the distal end 22 of the upper body arm 20 until the hole 68 is aligned with the two cylindrical openings 23 on opposite sides of recess 24. A cylindrical pin 74 is then inserted through the aligned openings 23 and 68. The cylindrical pin 74 will however extend slightly below the bottom of the semi-elliptical hole 68 in the spring housing yoke 60. In other words, in the configuration, the pin 68 will extend below the two downwardly facing surfaces 62 flanking the opening 68. The pin will therefore engage the top compression spring washer to further compress the stack of compression springs or Belleville springs 70. The stack of compression springs 70 will no longer bear on the surfaces 62, but will bear on the cylindrical pin 74. This will then allow the spring housing 52 to rotate, pivot or tilt until the top surface 56 of the spring housing plate abuts the underside of the upper arm 20. The inclined surface 25 on the underside of the distal upper arm end 22 will allow the spring housing to tilt beyond the horizontal or beyond a plane that is parallel to the upper surface of the base arm 12.

With the spring housing assembly 50 mounted on the jet body 10 in this manner the jet carriage 40 and the jet or nozzle insert 30 can be mounted on the jet body 10. Details of the jet insert 30 and the carriage 40 are shown in FIGS. 16–19. It should be understood that the jet insert 30 and the carriage 40 can be identical to inserts and insert carriages that are used with conventional textile interlacing slide jets.

The jet or nozzle insert 30 is a ceramic member having a semicylindrical yarn channel 32 extending between opposite sides of the insert 30. The yarn channel 32 extends into the top surface 36, and its axis is perpendicular to the longer sides of the insert 30. This yarn channel 32 is an open channel in which yarn can be inserted from above when the interlacing jet assembly 2 is in the open position. The insert 30 also includes an orifice 34 extending upward from the bottom of the insert 30 and intersecting the yarn channel 32 between opposite ends. It should be understood that this invention could also be employed with an insert having multiple air jet orifices intersecting yarn channel.

The jet nozzle insert 30 can be attached to a jet carriage 40 by screws (not shown) on opposite sides of the air orifice 34. The jet carriage 40 is a rectangular plastic member that has an upper compartment 44 in which the jet insert 30 is mounted. A bottom rectangular compartment 42 is dimensioned to receive the top edge of the base arm 12 on the jet body 10. The lower compartment 42 has one open end so that it can be inserted on the base distal end 14. The body base arm 12 slides within the compartment 42 when the jet carriage 40, with the jet insert 30 mounted thereon, is moved between the open and closed positions. Since the jet carriage 40 moves in a linear manner, this type of jet assembly is typically referred to as a slide jet. The jet carriage 40 also includes an upwardly facing slot 38 in which the actuating pin 84 on the lever 80 is received so that rotation of the lever 80 imparts linear movement to the jet carriage 40.

The instant invention provides a means for removing and inserting the jet carriage 40, with the jet insert 30 attached, from and onto the jet body 10 without the need for special tools. To remove the jet carriage 40 and the insert 30 from the jet body, the lever 80 should first be rotated to its fully open position as shown in FIG. 1. Complete rotation of the lever 80 will shift the actuating pin 84 so that it will clear the carriage slot 38, one end of which is shorter than the other. With the lever 80 in this position, the distal end of the carriage can be grasped and an extraction force should be applied. The compression springs 70 will exert a force on the top surface 36 of the jet insert 30, and a sufficient force must be applied to overcome this force. However, both the bottom layer 66 on the spring housing assembly and the jet or nozzle insert are manufactured from a ceramic that has a polished or smooth surface that results in a sufficiently low coefficient of friction to permit relative movement of the jet carriage 40 relative to the jet body 10 and the spring housing assembly 50. As the jet carriage 40 is removed, the spring housing assembly 50 can rotate or tilt to the position shown in FIG. 1. The inclined surface 25 provides clearance to permit the spring housing assembly to tilt. The stack of compression springs bear against the pin 74 so the springs will not directly engage the undersurface of the upper arm 20, and will not therefore prevent the spring housing assembly 50 from tilting to the position shown in FIG. 1. As the jet carriage 40 is progressively removed, the center of the contact surface between the jet carriage 40 and the bottom layer 66 will shift relative to the center of the compression spring washers 70, which will cause the spring housing assembly 70 to tilt in this manner.

With the spring housing assembly 50 tilted in the manner shown in FIG. 1, the jet carriage can be initially inserted beneath the ceramic bottom layer 66. Continued application of a linear insertion force to the jet carriage 40 will cause the spring housing assembly 50 to rotate back to its position where the bottom layer 66 is flush with the top surface 36 of the jet insert 30. When the jet carriage 40 is inserted to the point at which the actuating pin 84 is above the slot 38, the lever 80 can be rotated and rotation of the lever 80 will impart linear movement of the jet carriage 40 between the open and closed position. This entire operation will have been carried out without the need for special tools or keys.

I claim:

1. A textile interlacing jet comprising;

a body including a compressed air inlet;

an interlacing jet insert mounted on a jet carriage, the jet carriage being slidably mounted on the body so that the jet carriage can be shifted between an open position and a closed position in which the interlacing jet insert is aligned with the compressed air inlet; and a spring housing assembly mounted on the body above the compressed air inlet, and including at least one compression spring washer positioned to exert a force against the interlacing jet tending to retain the jet carriage on the body as the jet carriage slides between the open and closed positions.

2. The interlacing jet of claim 1 wherein a stack of compression spring washers, including the at least one compression spring washer, are positioned in the spring housing assembly.

3. The interlacing jet of claim 2 wherein the compression spring washers comprise Belleville spring washers.

4. The interlacing jet of claim 1 wherein the spring housing assembly includes a spring housing including a cavity in which each compression spring washer is positioned.

5. The interlacing jet of claim 4 wherein the spring housing includes a plate in which the cavity is formed.

6. The interlacing jet of claim 5 wherein the cavity extends between top and bottom surfaces of the plate.

7. The interlacing jet of claim 5 wherein a retaining washer is positioned within the cavity to secure one end of a stack of spring washers, including the at least one spring washer, within the cavity.

8. The interlacing jet of claim 7 wherein an opposite end of the stack of spring washers engages an opposing surface on the spring housing above the plate.

9. The interlacing jet of claim 7 wherein a pin extends through the spring housing and engages an opposite end of the stack of spring washers to compress the spring washers.

10. The interlacing jet of claim 5 wherein a bottom layer, comprised of a material having a lower coefficient of friction than the plate is secured to a bottom surface of the plate.

11. A textile interlacing jet comprising:

an interlacing jet insert mounted on a jet carriage, slidably mounted on a body;

the body comprising a base including a compressed air inlet extending through the base, and with an upper arm spaced from the base and extending over the base and over the compressed air inlet; and a compression spring attached to the upper arm above the compressed air inlet, the compression spring pressing a slide layer into engagement with a top surface of the interlacing jet insert to retain the interlacing jet insert and the jet carriage as the jet carriage is moved linearly relative to the body.

12. The interlacing jet of claim 11 wherein the interlacing jet insert and the jet carriage can be removed from the body by only the application of a linear force to slide the jet carriage off a distal end of the base.

13. The interlacing jet of claim 11 wherein the upper arm comprises a cantilever beam.

14. The interlacing jet of claim 1 wherein the base and the upper arm comprise parts of the same one piece member.

15. The interlacing jet of claim 14 wherein an upright rear arm extends between the base and the upper arm, which forms a cantilever beam extending from the upright rear arm.

16. The interlacing jet of claim 15 wherein the body comprises an extruded member, with the compressed air inlet machined in the base.

17. The interlacing jet of claim 16 wherein the body comprises an extruded aluminum member.

18. The interlacing jet of claim 11 wherein the compression spring is positioned within a spring housing that is attached to a distal end of the upper arm.

19. The interlacing jet of claim 18 wherein the spring housing is pinned to the upper arm, so that the spring housing can rotate relative to the upper arm, to the base, to the interlacing jet insert and to the jet carriage.

20. The interlacing jet of claim 11 wherein the spring comprises a series of spring washers.

21. A textile interlacing jet comprising:

a body, having an upper section and a lower section in opposing relationship;

an interlacing jet insert;

a jet carriage, the interlacing jet insert being mounted on the jet carriage, the jet carriage being slideably mounted on the lower section of the body; and a spring housing assembly, including a spring housing with a bottom layer and a spring positioned above the bottom layer; the spring housing assembly extending between the upper section and the lower section of the body, the spring housing being attached to the upper section of the body by a pin so that the spring housing can rotate relative to the body with the spring being positioned to press the spring housing bottom layer against a top surface of the interlacing jet insert to retain the jet carriage on the body while permitting the interlacing jet and jet carriage to slide relative to the body and to the spring housing assembly.

22. The interlacing jet of claim 21 wherein the spring housing rotates to a tilted position in which the spring, housing is positioned at an angle when the jet carriage and the interlacing jet insert are removed from the lower section of the body.

23. The interlacing jet of claim 22 wherein the spring housing rotates to a position in which the bottom layer of the spring, housing is parallel to the lower body section when the jet carriage and the interlacing jet are inserted on the body.

24. The interlacing jet of claim 21 wherein the spring is compressed when the jet and the interlacing jet are inserted on the body.

25. The interlacing jet of claim 21 wherein the spring housing is tilted by insertion and extraction of the jet carriage, with a jet insert attached thereto, from the lower section of the body.

26. The interlacing jet of claim 21 wherein the upper and lower sections of the body comprise two arms spaced apart by a gap in which the jet carriage and the interlacing jet can be positioned.

27. The interlacing jet of claim 21 wherein the spring comprises at least one spring washer.

28. The interlacing jet of claim 21 wherein the spring housing bottom layer and the interlacing jet insert are fabricated from the same material, which has a sufficiently low coefficient of friction so that the interlacing jet insert can slide relative to the bottom layer.

29. The interlacing jet of claim 21 wherein the spring housing includes a yoke extending into a recess on a distal end of the upper section of the body, the pin extending through the yoke and into portions of the upper section of the body on opposite sides of the recess, with the spring being trapped between the pin and the bottom layer.

30. The interlacing jet of claim 21 including a lever for imparting linear movement of the jet carriage between an open position and a closed position in which yarn strands can be interlaced by high pressure injection of gas through the interlacing jet insert.

* * * * *